US007867039B2

(12) United States Patent
Yoon et al.

(10) Patent No.: US 7,867,039 B2
(45) Date of Patent: Jan. 11, 2011

(54) BULB SOCKET

(75) Inventors: Byung-Chan Yoon, Gyeonggi-do (KR); Suk-Min Kim, Seoul (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/532,865

(22) PCT Filed: Mar. 28, 2008

(86) PCT No.: PCT/KR2008/001747

§ 371 (c)(1),
(2), (4) Date: Mar. 22, 2010

(87) PCT Pub. No.: WO2008/120910

PCT Pub. Date: Oct. 9, 2008

(65) Prior Publication Data

US 2010/0184336 A1 Jul. 22, 2010

(30) Foreign Application Priority Data

Mar. 30, 2007 (KR) ..... 10-2007-0031725

(51) Int. Cl.
*H01R 24/00* (2006.01)

(52) U.S. Cl. ..... 439/699.2

(58) Field of Classification Search ..... 439/699.2, 439/459, 456, 660; 362/186, 205
See application file for complete search history.

(56) References Cited

U.S. PATENT DOCUMENTS

| | | | | |
|---|---|---|---|---|
| 4,428,034 | A * | 1/1984 | Seller | 362/186 |
| 6,171,135 | B1 * | 1/2001 | Yang | 439/456 |
| 6,514,105 | B2 * | 2/2003 | Lin | 439/699.2 |
| 6,626,707 | B2 * | 9/2003 | Henrici et al. | 439/699.2 |
| 6,648,691 | B2 * | 11/2003 | Henrici et al. | 439/619 |
| 6,974,354 | B2 * | 12/2005 | Wu | 439/699.2 |
| 7,063,576 | B2 * | 6/2006 | Ooi et al. | 439/699.2 |
| 7,670,195 | B2 * | 3/2010 | Atalay | 439/699.2 |

FOREIGN PATENT DOCUMENTS

JP 2000-252028 A 9/2000

OTHER PUBLICATIONS

International Search Report for PCT/KR2008/001747.

* cited by examiner

*Primary Examiner*—Chandrika Prasad
(74) *Attorney, Agent, or Firm*—Larry I. Golden

(57) ABSTRACT

Provided is a bulb socket. The bulb socket includes a housing formed as a single piece using a single mold assembly, a couple of lamp holders, a double contact terminal, and a single contact terminal.

5 Claims, 4 Drawing Sheets

[Fig. 1]
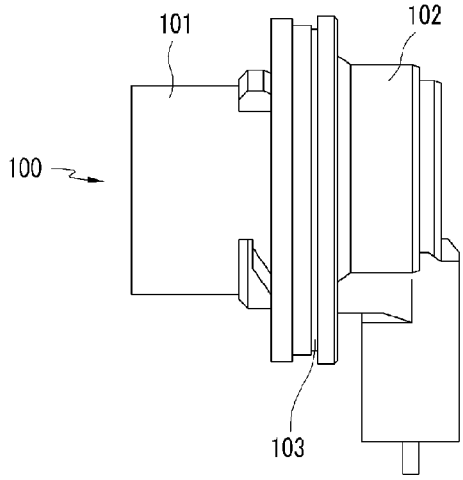
[Fig. 2]
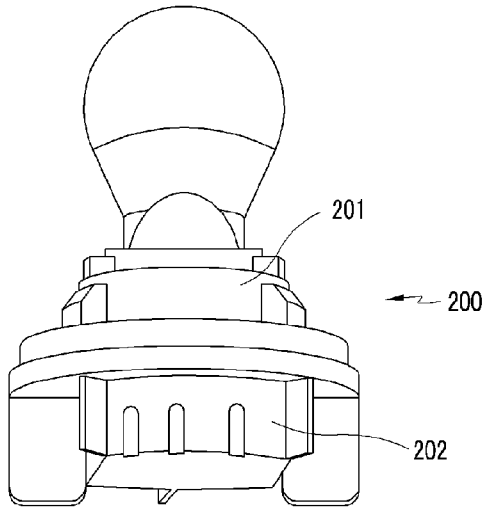
[Fig. 3]
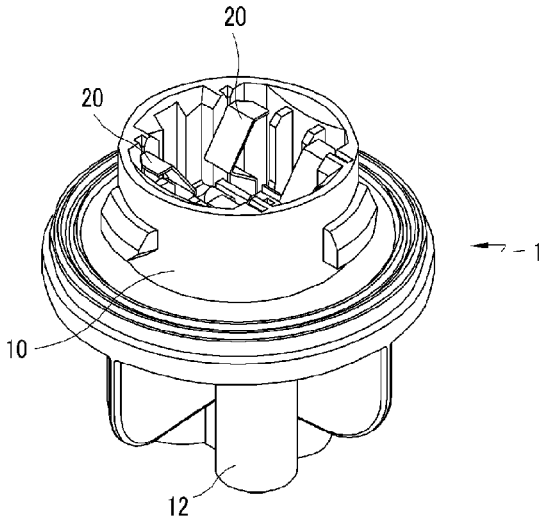

[Fig. 4]
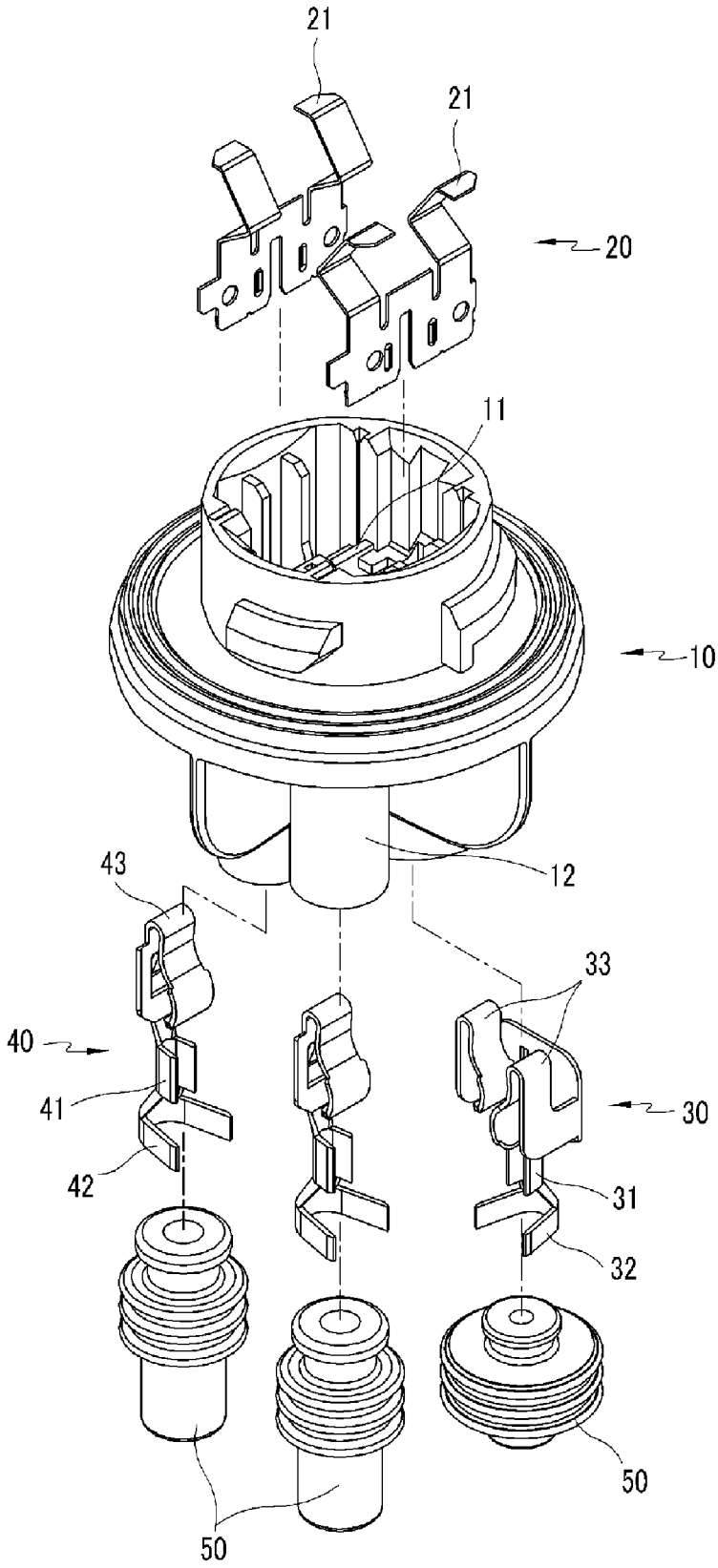

[Fig. 5]
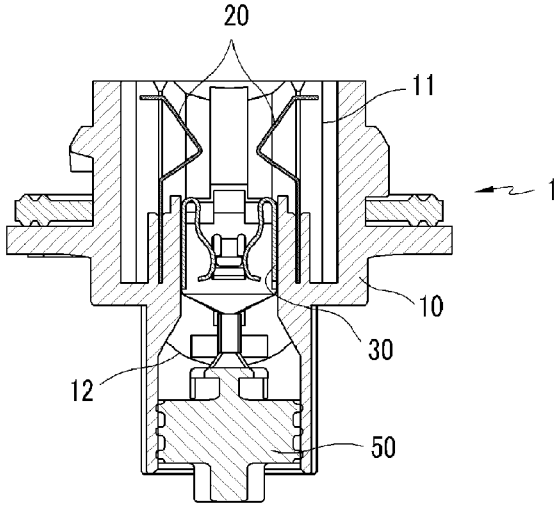
[Fig. 6]
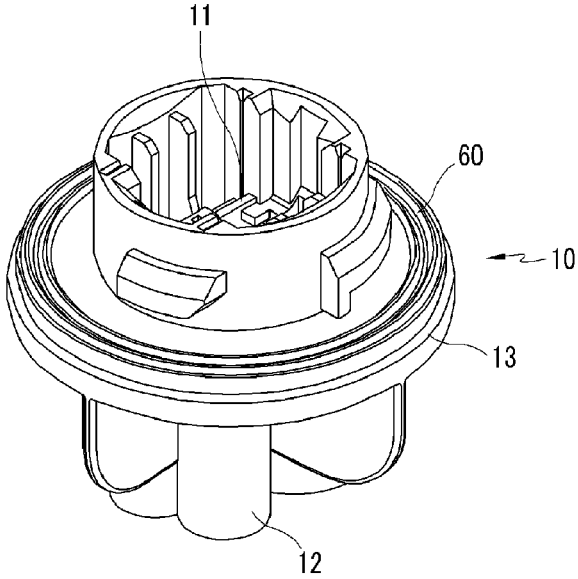
[Fig. 7]
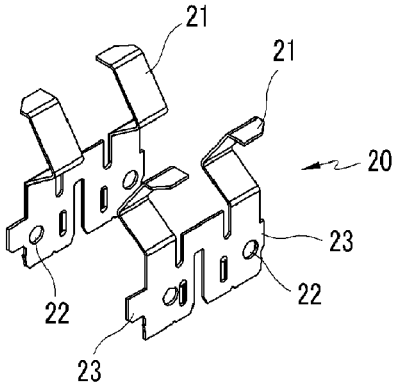

[Fig. 8]
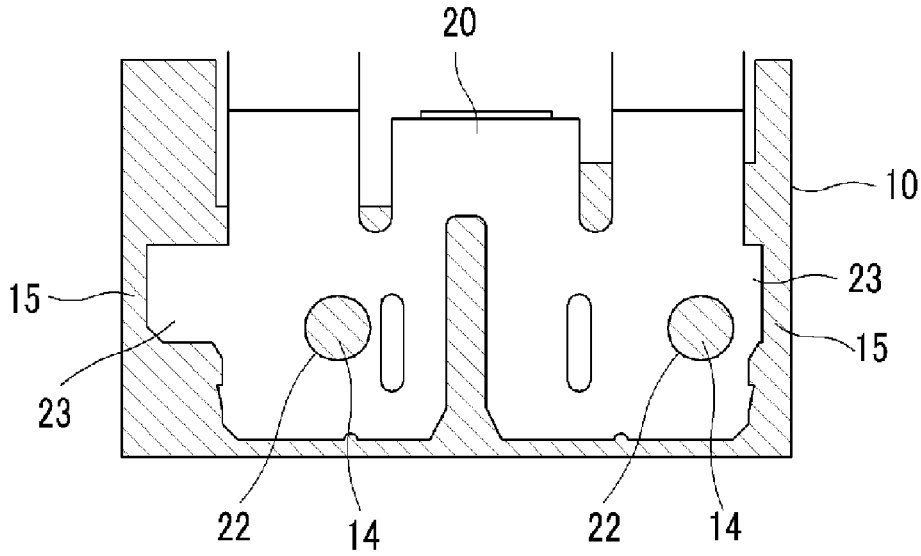
[Fig. 9]
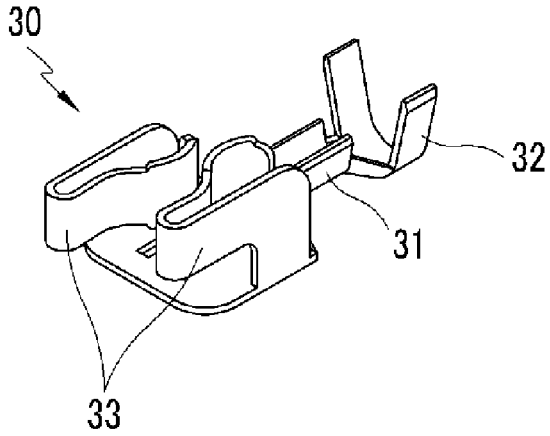
[Fig. 10]
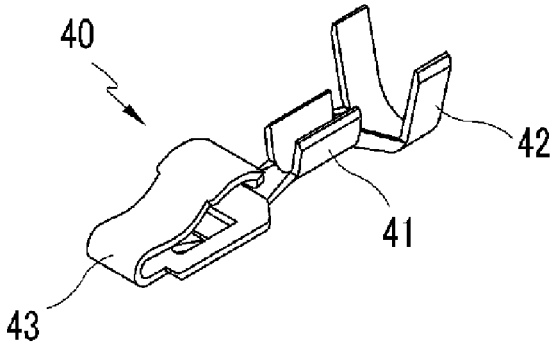

BULB SOCKET

TECHNICAL FIELD

The present invention relates to a bulb socket, and more particularly, to a bulb socket having a housing formed as a single piece using an injection molding process, which can improve durability and productivity of the bulb socket and performance of various parts in the bulb socket so as to improve assemblability of the bulb socket.

BACKGROUND ART

Bulb sockets are apparatuses for supporting a bulb as well as open apertures for supplying electricity to the bulb. Such bulb sockets are classified into Edison type bulb sockets into which a bulb is screwed, and Swan type bulb sockets into which a bulb is pushed, depending on methods of locating a bulb in a socket.

The Edison type bulb sockets are applied to domestic electric apparatuses, and the Swan type bulb sockets are applied to automobiles and other electric apparatuses.

Specifically, the Swan type bulb sockets have a complex and accurate configuration, thus careful attention is required in manufacture and manufacturing costs are higher in comparison with the Edison type bulb sockets.

Referring to FIG. 1, such a swan type bulb socket includes a housing 100 into which a bulb is inserted and fixed, and various contact terminals and wires in the housing 100. The housing 100 includes a front piece 101 formed using a front mold assembly and a rear piece 102 formed using a rear mold assembly. A seal 103 is disposed in a coupling portion of the front and the rear pieces 101 and 102 to provide sealing performance.

Since the socket with the aforementioned configuration requires spot-welding for coupling the contact terminals, a welder and a welding line is also provided.

Since the housing 100 of the bulb socket includes the pieces 101 and 102, automatic pressing cannot be performed on the pieces 101 and 102, thus increase pressing costs. Also, a manufacturing process for the bulb socket is complicated and manufacturing costs are relatively high.

Referring to FIG. 2, a related art bulb socket 200, which is an epoxy type bulb socket, includes a socket piece 201 and an epoxy-flow-prevention piece 202. Thus, an automatic epoxy dispenser and a chamber for curing epoxy are required.

Also, the bulb socket 200 requires a separate dedicated line for injecting and curing the epoxy after connecting wires, thus a manufacturing process is complicated and manufacturing costs are relatively high.

DISCLOSURE OF INVENTION

Technical Problem

The present invention has been made in an effort to solve the above-described problems of the related art. An object of the present invention is to provide a bulb socket having a housing formed as a single piece using a mold assembly, which can improve durability and productivity of the socket and performance of various parts in the socket, so as to improve assemblability of the socket.

Technical Solution

To achieve the objects of the present invention, there is provided a bulb socket including: a housing formed as a single piece using a single mold assembly, the housing including an inner upper portion having a receiving space into which a body of a bulb is capable of being inserted and fixed, and an inner lower portion having a fixing portion to which various parts are coupled; a couple of lamp holders, each including an elastic beam coupled to an inner wall of the receiving space of the housing, the elastic beam being bent such that the elastic beam is in contact with and fixed to the body of the bulb, elastically; a double contact terminal including a first and a second sides separated by a terminal body connected to a wire, the first side having a fixing member bent and fixed to one of wire seals, the second side having a couple of terminals; and a single contact terminal including a first and a second sides separated by a terminal body connected to a wire, the first side having a fixing member bent and fixed to another of the wire seals, the second side having a single terminal.

Also, the housing includes a circular-plate-shaped flange disposed along an outer circumference of a middle portion thereof, and a ring-shaped gasket disposed on an upper portion of the flange to provide sealing performance.

Also, the inner wall of the receiving space of the housing includes a plurality of assembling protrusions and a plurality of fixing recesses to insert and fix the lamp holders.

Also, each of the lamp holders comprises a body including a fixing hole and a wedge respectively corresponding to each of the assembling protrusions and each of the fixing recesses so as to be coupled to the housing.

Also, the wedges respectively disposed on left and right sides of each of the lamp holders have different widths with each other, to prevent an error in coupling the lamp holders to the housing.

BRIEF DESCRIPTION OF THE DRAWINGS

FIG. 1 is a schematic view illustrating a bulb socket according to a related art.

FIG. 2 is a perspective view illustrating a bulb socket according to a related art.

FIG. 3 is a perspective view illustrating a bulb socket according to an embodiment of the present invention.

FIG. 4 is an exploded perspective view illustrating a configuration of a bulb socket according to an embodiment of the present invention.

FIG. 5 is a cross-sectional view illustrating an inner configuration of a bulb socket according to an embodiment of the present invention.

FIG. 6 is a perspective view illustrating a housing of a bulb socket according to an embodiment of the present invention.

FIG. 7 is a perspective view illustrating lamp holders of a bulb socket according to an embodiment of the present invention.

FIG. 8 is a cross-sectional view illustrating the lamp holder illustrated in FIG. 7, which is installed.

FIG. 9 is a perspective view illustrating a double contact terminal of a bulb socket according to an embodiment of the present invention.

FIG. 10 is a perspective view illustrating a single contact terminal of a bulb socket according to an embodiment of the present invention.

DESCRIPTION OF THE SYMBOLS IN MAIN PORTIONS OF THE DRAWINGS

1: Bulb socket
10: Housing
11: Receiving space

12: Fixing portion
13: Flange
14: Assembling protrusions
15: Fixing recess
20: Lamp holder
21: Elastic beam
22: Fixing hole
23: Wedge
30: Double contact terminal
31: Terminal body
32: Fixing member
33: Terminal
40: Single contact terminal
41: Terminal body
42: Fixing member
43: Terminal
50: Wire seal
60: Gasket

Best Mode for Carrying Out the Invention

Hereinafter, the present invention will now be described in detail with reference to the accompanying drawing.

Referring to FIGS. 3 and 4, a configuration of a bulb socket 1 will now be described. A bulb is inserted and fixed into the bulb socket 1 such that the bulb socket 1 is electrically connected to the bulb. The bulb socket 1 includes a cylindrical housing 10, in which the cylindrical housing 10 is coupled with a pair of lamp holders 20, a double contact terminal 30, single contact terminals 40, and wires and wire seals 50.

That is, the housing 10 of the bulb socket 1 includes a receiving space 11 in its inner upper portion and a fixing portion 12 in its inner lower portion. A body of a bulb is inserted and fixed into the receiving space 11, and various parts are coupled to the fixing portion 12. Specifically, the housing 10 is characterized to be a single piece formed using a mold assembly.

Also, each of the lamp holders 20 includes a bent elastic beam 21 that is coupled to an inner wall of the receiving space 11 of the housing 10 to be in elastic contact with and fixed to the body of the bulb. Thus, the body of the bulb is inserted and fixed into the elastic beam 21.

Also, the double contact terminal 30 disposed in the fixing portion 12 of the housing 10 includes a first and a second sides separated by a terminal body 31 connected to the wire. The first side includes a fixing member 32 bent and fixed to one of the wire seals 50, and the second side includes a couple of terminals 33.

Each of the single contact terminals 40 disposed in the fixing portion 12 of the housing 10 includes a first and a second sides separated by a terminal body 41 connected to the wire. The first side includes a fixing member 42 bent and fixed to another of the wire seals 50, and the second side includes a terminal 43.

Thus, referring to FIG. 5, the bulb socket 1 formed using the single mold assembly includes a space for receiving various parts. The couple of lamp holders 20, which are symmetrical to each other, are inserted and fixed into the receiving space 11 in the upper portion of the housing 10. The double contact terminals 30 and the single contact terminal 40, which are connected to the wires, are inserted and fixed into the fixing portion 12 in the lower portion of the housing 10. The wire seals 50 are respectively fixed to lower ends of the double contact terminal 30 and the single contact terminals 40.

Referring to FIG. 6, the housing 10 in the bulb socket 1 includes a cylindrical portion having the receiving space 11 in the upper portion, and a circular plate shaped flange 13 disposed along an outer circumference of a middle portion thereof. A ring shaped gasket 60, for providing sealing performance, is disposed on an upper portion of the flange 13. The wire seals 50, connected to the double contact terminal 30 and the single contact terminals 40, are inserted and fixed into the cylindrical fixing portion 12 below the flange 13.

The gasket 60 on the housing 60 is formed of an oil silicon to improve its durability and heat resistance.

The housing 10 is formed using the single mold assembly so as to have two spaces for receiving various parts, and formed of a high heat-resistance material to be resistant to heat of a bulb or a lamp.

FIG. 7 is a perspective view illustrating the lamp holders 20, and FIG. 8 is a schematic view illustrating the lamp holder 20 that is installed. Referring to FIGS. 7 and 8, a plurality of assembling protrusions 14 and a plurality of fixing recesses 15 are disposed in the inner wall of the receiving space 11 of the housing 10. Each of the lamp holders 20 includes fixing holes 22 and wedges 23 respectively corresponding to the assembling protrusions 14 and the recesses 15 to be coupled to the housing 10.

That is, the assembling protrusions 14 of the housing 10 are respectively inserted into the fixing holes 22 of the lamp holders 20, the wedges 23 are respectively inserted into the recesses 15 of the housing 10. Thus, the lamp holders 20 are firmly fixed to the housing 10.

The wedges 23 respectively disposed on left and right sides of each of the lamp holders 20 have different widths with each other, thus prevent an error in coupling the lamp holder 20 to the housing 10. Since the widths of the wedges 23 are different from each other, if an assembly direction of the lamp holders 20 is wrong, the lamp holders 20 are not inserted into the housing 10, thus prevent an error in coupling the lamp holders 20 to the housing 10.

Also, each of the lamp holders 20 is double-locked into the housing 10 to be firmly fixed. Also, the widths of the wedges 23 on the both sides of the lamp holders 20 are different from each other, thus ensure correct coupling of the lamp holders 20.

Referring to FIG. 9, the double contact terminal 30 includes the terminal body 31 connected to the wire, the bent fixing member 32 fixed to the wire seal 50 and disposed at the first sides separated by the terminal body 31, and the couple of terminals 33 disposed at the second side separated by the terminal body 31.

That is, the double contact terminal 30 is connected to the wire and simultaneously fixed to an inner side of the housing 10. Also, the terminal body 31 includes the couple of terminals 33. Thus, assemblability and stability of parts can be improved.

Referring to FIG. 10, each of the single contact terminal 40 includes the terminal body 41 connected to the wire, the bent fixing member 42 fixed to the wire seal 50 and disposed at the first side separated by the terminal body 41, and the terminal 43 disposed at the second side separated by the terminal body 41.

That is, each of the single contact terminals 40 is connected to the wire and simultaneously fixed to the inner side of the housing 10, and each of the wire seals 50, for fixing the wire, is fixed to a lower end of the single contact terminal 40.

The wire seals 50, fixed to the double contact terminal 30 and the single contact terminal 40, are formed of an oil silicon to be easy to protect the wires. Also, when the wires are bent, the wire seals 50 elastically hold the wires to prevent a short circuit of the wires.

Thus, performance of the various parts in the bulb socket 1 is enhanced to improve durability and quality of the bulb socket 1.

INDUSTRIAL APPLICABILITY

As described above, the bulb socket of the present invention includes the housing formed as a single piece using a mold assembly, thus a manufacturing process is simple and manufacturing costs are reduced. Also, the socket is formed of a material having high durability and high heat resistance, thus durability and quality of a product can be improved. Also, function and assemblability of various parts in the sockets are improved, thus workability and productivity of a product are improved.

What is claimed is:

1. A bulb socket comprising:

a housing formed as a single piece using a single mold assembly, the housing including an inner upper portion having a receiving space into which a body of a bulb is capable of being inserted and fixed, and an inner lower portion having a fixing portion to which various parts are coupled;

a couple of lamp holders, each including an elastic beam couples to an inner wall of the receiving space of the housing, the elastic beam being bent such that the elastic beam is in contact with and fixed to the body of the bulb, elastically;

a double contact terminal including a first and a second sides separated by a terminal body connected to a wire, the first side having a fixing member bent and fixed to one of wire seals, the second side having a couple of terminals; and a single contact terminal including a first and a second sides separated by a terminal body connected to a wire, the first side having a fixing member bent and fixed to another of the wire seals, the second side having a single terminal.

2. The bulb socket of claim 1, wherein the housing comprises a circular-plate-shaped flange disposed along an outer circumference of a middle portion thereof, and a ring-shaped gasket disposed on an upper portion of the flange to provide sealing performance.

3. The bulb socket of claim 1, wherein the inner wall of the receiving space of the housing comprises a plurality of assembling protrusions and a plurality of fixing recesses to insert and fix the lamp holders.

4. The bulb socket of claim 1, wherein each of the lamp holders comprises a body including a fixing hole and a wedge respectively corresponding to each of the assembling protrusions and each of the fixing recesses so as to be couples to the housing.

5. The bulb socket of claim 4, wherein the wedges respectively disposed on left and right sides of each of the lamp holders are different in width, to prevent an error in coupling the lamp holders to the housing.

* * * * *

UNITED STATES PATENT AND TRADEMARK OFFICE

CERTIFICATE OF CORRECTION

PATENT NO. : 7,867,039 B2
APPLICATION NO. : 12/532865
DATED : January 11, 2011
INVENTOR(S) : Yoon et al.

It is certified that error appears in the above-identified patent and that said Letters Patent is hereby corrected as shown below:

Col. 6, lines 18-22 correct as shown

4. The bulb socket of claim ~~1~~ 3, wherein each of the lamp holders comprises a body including a fixing hole and a wedge respectively corresponding to each of the assembling protrusions and each of the fixing recesses so as to be ~~couples~~ coupled to the housing.

Signed and Sealed this
Eighth Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,867,039 B2
APPLICATION NO. : 12/532865
DATED : January 11, 2011
INVENTOR(S) : Yoon et al.

It is certified that error appears in the above-identified patent and that said Letters Patent is hereby corrected as shown below:

Col. 6, lines 18-22, claim 4 should read as shown

4. The bulb socket of claim 3, wherein each of the lamp holders comprises a body including a fixing hole and a wedge respectively corresponding to each of the assembling protrusions and each of the fixing recesses so as to be coupled to the housing.

This certificate supersedes the Certificate of Correction issued November 8, 2011.

Signed and Sealed this
Sixth Day of March, 2012

David J. Kappos

David J. Kappos
*Director of the United States Patent and Trademark Office*